US006361615B1

(12) United States Patent
Callahan

(10) Patent No.: US 6,361,615 B1
(45) Date of Patent: Mar. 26, 2002

(54) CLEANING COMPOUND ADDITIVE AND METHOD

(76) Inventor: Michael L. Callahan, 11207 Coble Rd., Charlotte, NC (US) 28227

( * ) Notice: Subject to any disclaimer, the term of this patent is extended or adjusted under 35 U.S.C. 154(b) by 0 days.

(21) Appl. No.: 09/262,201

(22) Filed: Mar. 4, 1999

(51) Int. Cl.[7] ..... B08B 3/04

(52) U.S. Cl. ..... 134/6; 134/7; 134/34; 134/36; 134/40; 134/42; 510/180; 510/181; 510/182; 510/224; 510/446

(58) Field of Search ..... 510/180, 181, 510/182, 224, 446; 134/6, 7, 42, 36, 34, 40

(56) References Cited

U.S. PATENT DOCUMENTS

| | | | | | |
|---|---|---|---|---|---|
| 301,637 | A | * | 7/1884 | Somerville, Sr. et al. | |
| 2,931,776 | A | * | 4/1960 | Howard et al. | 252/99 |
| 3,337,466 | A | * | 8/1967 | Puetzer et al. | 252/99 |
| 3,607,759 | A | * | 9/1971 | Barth | 252/100 |
| 4,502,892 | A | * | 3/1985 | Westermann et al. | 134/6 |
| 4,507,155 | A | * | 3/1985 | Cheek | 134/6 |
| 5,688,356 | A | * | 11/1997 | Sagiv | 156/331.7 |
| 5,711,956 | A | * | 1/1998 | Wedlock et al. | 424/409 |

OTHER PUBLICATIONS

Aldrich Chemical company, Inc. p. 106, 1988.*

World Wide Web page of "The World's Best Products" describing "303 Instant Windshield Washer Tablets". Dated Jun. 29, 1999. P.O. Box 966, Palo Cedro, CA 96073–0966.

* cited by examiner

*Primary Examiner*—Sharidan Carrillo

(57) ABSTRACT

A cleaning compound additive for adding to water or windshield wiper fluid to aid removal of insect splatters from a windshield. The cleaning compound additive includes the combination of effective amounts of anhydrous ammonia, alkoxylated linear alcohols sold under the trade name SURFONIC, dry particulate sodium bicarbonate, dry particulate polyvinyl pyrrolidone, dry particulate orange dye, and dry particulate citrus orange scent.

1 Claim, 1 Drawing Sheet

CLEANING COMPOUND ADDITIVE AND METHOD

BACKGROUND OF THE INVENTION

1. Field of the Invention

The present invention relates to cleaning compounds for cleaning insect splatters from a windshield and more particularly pertains to a new cleaning compound additive for adding to water or windshield wiper fluid to aid removal of insect splatters from a windshield.

2. Description of the Prior Art

The use of cleaning compounds for cleaning insect splatters from a windshield is known in the prior art. More specifically, cleaning compounds for cleaning insect splatters from a windshield heretofore devised and utilized are known to consist basically of familiar, expected and obvious configurations, notwithstanding the myriad of designs encompassed by the crowded prior art which have been developed for the fulfillment of countless objectives and requirements.

Known prior art includes U.S. Pat. No. 4,507,155; U.S. Pat. No. 5,711,956; U.S. Pat. No. 3,607,759; U.S. Pat. No. 3,337,466; U.S. Pat. No. 2,931,776; and U.S. Pat. No. Des. 301,637.

While these compositions fulfill their respective, particular objectives, and requirements, the aforementioned patents do not disclose a new cleaning compound additive. The inventive compound includes the combination of effective amounts of anhydrous ammonia, alkoxylated linear alcohols sold under the trade name SURFONIC, dry particulate sodium bicarbonate, dry particulate polyvinyl pyrrolidone, dry particulate orange dye, and dry particulate citrus orange scent.

In these respects, the cleaning compound additive according to the present invention substantially departs from the conventional concepts and designs of the prior art, and in so doing provides an compound primarily developed for the purpose of adding to water or windshield wiper fluid to aid removal of insect splatters from a windshield.

SUMMARY OF THE INVENTION

In view of the foregoing disadvantages inherent in the known types of cleaning compounds for cleaning insect splatters from a windshield now present in the prior art, the present invention provides a new cleaning compound additive construction wherein the same can be utilized for adding to water or windshield wiper fluid to aid removal of insect splatters from a windshield.

The general purpose of the present invention, which will be described subsequently in greater detail, is to provide a new cleaning compound additive composition and method which has many of the advantages of the cleaning compounds for cleaning insect splatters from a windshield mentioned heretofore and many novel features that result in a new cleaning compound additive which is not anticipated, rendered obvious, suggested, or even implied by any of the prior art cleaning compounds for cleaning insect splatters from a windshield, either alone or in any combination thereof.

To attain this, the present invention generally comprises the combination of effective amounts of anhydrous ammonia, alkoxylated linear alcohols sold tinder the trade name SURFONIC, dry particulate sodium bicarbonate, dry particulate polyvinyl pyrrolidone, dry particulate orange dye, and dry particulate citrus orange scent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is to be understood that the phraseology and terminology employed herein are for the purpose of description and should not be regarded as limiting.

As such, those skilled in the art will appreciate that the conception, upon which this disclosure is based, may readily be utilized as a basis for the designing of other compositions, methods and systems for carrying out the several purposes of the present invention. It is important, therefore, that the claims be regarded as including such equivalent compositions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cleaning compound additive compounds and method which has many of the advantages of the cleaning compounds for cleaning insect splatters from a windshield mentioned heretofore and many novel features that result in a new cleaning compound additive which is not anticipated, rendered obvious, suggested, or even implied by any of the prior art cleaning compounds for cleaning insect splatters from a windshield, either alone or in any combination thereof.

It is another object of the present invention to provide a new cleaning compound additive which may be easily and efficiently manufactured and marketed.

An even further object of the present invention is to provide a new cleaning compound additive which is susceptible of a low cost of manufacture with regard to both materials and labor, and which accordingly is then susceptible of low prices of sale to the consuming public, thereby making such cleaning compound additive economically available to the buying public.

Still another object of the present invention is to provide a new cleaning compound additive for adding to water or windshield wiper fluid to aid removal of insect splatters from a windshield.

Yet another object of the present invention is to provide a new cleaning compound additive which includes the combination of effective amounts of anhydrous ammonia, alkoxylated linear alcohols sold under the trade name SURFONIC, dry particulate sodium bicarbonate, dry particulate polyvinyl pyrrolidone, dry particulate orange dye, and dry particulate citrus orange scent.

Still yet another object of the present invention is to provide a new cleaning compound additive that enhances the ability for windshield wiper fluid to remove insect spatters from a windshield.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
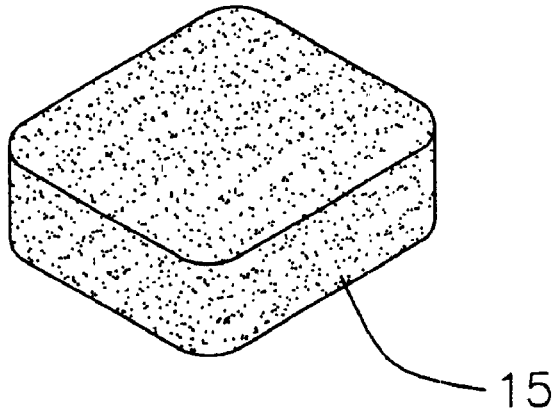
FIG. 1 is a schematic perspective view of the present invention formed into a tablet.
Figure 2:
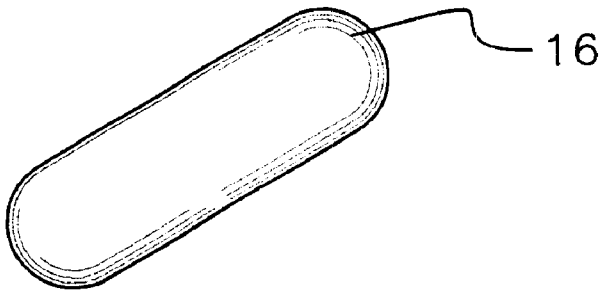
FIG. 2 is a schematic perspective view of the present invention in the delivery form of a water soluble gelatin capsule.

With reference now to the drawings, and in particular to FIGS. 1 through 2 thereof, a new cleaning compound additive embodying the principles and concepts of the present invention will be described.

The cleaning compound additive generally comprises the combination of effective amounts of anhydrous ammonia, alkoxylated linear alcohols sold under the trade name SURFONIC, dry particulate sodium bicarbonate, dry particulate polyvinyl pyrrolidone, dry particulate orange dye, and dry particulate citrus orange scent.

In closer detail, an effective amount cleaning additive is prepared by combining in a mixing chamber effective amounts of anhydrous ammonia, alkoxylated linear alcohols sold under the trade name SURFONIC, dry particulate sodium bicarbonate, dry particulate polyvinyl pyrrolidone (as a bonding agent), dry particulate orange dye, and dry particulate citrus orange scent to form the cleaning additive. The sodium bicarbonate serves as effervescing agent for aiding the dissolving and mixing of the cleaning additive in a water-based fluid. Preferably, the effective amounts of anhydrous ammonia, alkoxylated linear alcohols sold under the trade name SURFONIC, dry particulate sodium bicarbonate, dry particulate polyvinyl pyrrolidone, dry particulate orange dye, and dry particulate citrus orange scent are present in about equal %-amounts by weight of the total amount of cleaning additive. In other words, in this preferred embodiment the cleaning additive has equal parts of all of its ingredients.

The cleaning additive may then be placed in form molds to mold the cleaning additive into tablets 15 as illustrated in FIG. 1. The polyvinyl pyrrolidone serves as a bonding agent to hold the ingredients of the cleaning additive in the tablet form. Each tablet has an effective amount of cleaning additive provided therein. Each of the tablets is preferably generally rectangular in shape and ideally has a length between about ¼ inch and about ½ inch, a width between about ¼ inch and about ½ inch, and a thickness of about ¼ inch for optimally fitting through the refilling opening of the reservoirs of most windshield wiper washer fluid delivery systems. Alternatively, the cleaning additive may be inserted into a capsules 16 as illustrated in FIG. 2, comprising a water soluble gelatin. Each capsule has an effective amount of cleaning additive provided therein.

In use, the cleaning additive is dissolved in an effective amount (that is, volume) of water or commercially available water-based windshield wiper washer fluid to form a cleaning solution. The cleaning solution may then be poured into a reservoir of a windshield wiper washer fluid delivery system in a vehicle also a nozzle in fluid communication with the reservoir and a pump for spraying with the nozzle fluid from the reservoir on to a windshield of the vehicle. Optionally, the tablet or capsule form of the cleaning additive may be dropped into a reservoir already having a volume of water or windshield wiper washing fluid therein so that the cleaning additive can dissolve in the reservoir. The cleaning solution is applied to the windshield of the vehicle with the windshield wiper washer fluid delivery system to help loosen insect platters from the windshield of the vehicle. The windshield wipers of the vehicle are then activated to wipe the loosened insect platters off of the windshield to clean the windshield.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of cleaning insect splatters from a windshield of a vehicle comprising the acts of:

preparing an amount of cleaning additive comprising the steps of:

combining amounts of anhydrous ammonia, alkoxylated linear alcohols, dry particulate sodium bicarbonate, dry particulate polyvinyl pyrrolidone, dry particulate orange dye, and dry particulate citrus orange scent to form a cleaning additive;

wherein said amounts of alkoxylated linear alcohols, dry particulate sodium bicarbonate, dry particulate polyvinyl pyrrolidone, dry particulate orange dye, and dry particulate citrus orange scent are present in about equal %-amounts by weight of the total amount of cleaning additive;

molding said cleaning additive into tablets, each tablet having an amount of cleaning additive provided therein, each of said tablets being generally rectangular in shape and having a length, a width, and a thickness, wherein said length of each tablet is between about ¼ inch and about ½inch, wherein said width of each tablet is between about ¼ inch and about ½ inch, and wherein said thickness of each tablet is about ¼ inch;

dissolving said cleaning additive in an amount of water to form a cleaning solution;

providing a windshield wiper washer fluid delivery system in a vehicle having a reservoir for holding a fluid therein and a nozzle in fluid communication with said reservoir for spraying fluid from said reservoir on to a windshield of the vehicle;

said cleaning solution being provided in said reservoir; and applying said cleaning solution to the windshield of the vehicle with said windshield wiper washer fluid delivery system;

providing at least one windshield wiper on said vehicle; and wiping said windshield with said windshield wiper with said cleaning solution applied on a surface of said windshield such that movement of said windshield wiper across said windshield cleans said surface of said windshield by removing insect splatter present on said surface of said windshield.

* * * * *